US009080457B2

(12) United States Patent
Shi

(10) Patent No.: US 9,080,457 B2
(45) Date of Patent: Jul. 14, 2015

(54) EDGE SEAL FOR GAS TURBINE ENGINE CERAMIC MATRIX COMPOSITE COMPONENT

(71) Applicant: Rolls-Royce Corporation, Indianapolis (IN)

(72) Inventor: Jun Shi, Carmel, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 14/107,613

(22) Filed: Dec. 16, 2013

(65) Prior Publication Data

US 2014/0242348 A1 Aug. 28, 2014

Related U.S. Application Data

(60) Provisional application No. 61/768,450, filed on Feb. 23, 2013.

(51) Int. Cl.

| | |
|---|---|
| ***B21D 53/78*** | (2006.01) |
| ***F01D 11/00*** | (2006.01) |
| ***F01D 9/04*** | (2006.01) |

(52) U.S. Cl.

CPC ..... *F01D 11/005* (2013.01); *F01D 9/042* (2013.01); *F05D 2300/6033* (2013.01); *Y10T 156/10* (2013.01); *Y10T 428/24752* (2013.01)

(58) Field of Classification Search

CPC ..... F05D 2230/31; F05D 2300/6033; F05D 2300/603; F05D 2300/6034; F05D 2300/6032; F05D 2300/6012; F01D 11/005; B29C 70/42; B29C 70/44

USPC ..... 264/136, 137, 258

See application file for complete search history.

(56) References Cited

U.S. PATENT DOCUMENTS

| | | | |
|---|---|---|---|
| 4,326,835 | A | 4/1982 | Wertz |
| 4,415,309 | A | 11/1983 | Atterbury |
| 4,989,886 | A | 2/1991 | Rulis |
| 5,622,474 | A | 4/1997 | Werner et al. |
| 5,628,622 | A | 5/1997 | Thore et al. |
| 5,657,998 | A | 8/1997 | Dinc et al. |
| 5,678,898 | A | 10/1997 | Bagepalli et al. |
| 5,709,530 | A | 1/1998 | Cahill et al. |

(Continued)

FOREIGN PATENT DOCUMENTS

| | | | |
|---|---|---|---|
| EP | 1764481 | A2 | 3/2007 |
| EP | 1905956 | A2 | 4/2008 |
| EP | 1914454 | A1 | 4/2008 |

OTHER PUBLICATIONS

International Search Report for PCT International Application Serial No. PCT/US2013/075372, completed Apr. 24, 2014.

*Primary Examiner* — Christopher Besler

(74) *Attorney, Agent, or Firm* — Barnes & Thornburg LLP

(57) ABSTRACT

A gas turbine engine ceramic matrix composite (CMC) component includes first and second outer layers of plies, and an intermediate layer of plies between the first and second outer layers of plies. The intermediate layer of plies is offset relative to the first and second outer layers of plies. The offset forms a protrusion on one side of the CMC component and a recess in an opposite side of the CMC component such that when two CMC components are assembled together, the protrusion of the one CMC component engages the recess of the other CMC component to form an edge seal between the CMC components.

17 Claims, 3 Drawing Sheets

(56) References Cited

U.S. PATENT DOCUMENTS

| | | | |
|---|---|---|---|
| 5,785,499 | A | 7/1998 | Houston et al. |
| 5,915,697 | A | 6/1999 | Bagepalli et al. |
| 5,967,745 | A | 10/1999 | Tomita et al. |
| 6,000,906 | A | 12/1999 | Draskovich |
| 6,173,958 | B1 | 1/2001 | Dinc et al. |
| 6,273,683 | B1 | 8/2001 | Zagar et al. |
| 6,409,473 | B1 | 6/2002 | Chen et al. |
| 6,464,456 | B2 | 10/2002 | Darolia et al. |
| 6,471,472 | B1 | 10/2002 | Stauder et al. |
| 6,652,231 | B2 | 11/2003 | Vedantam et al. |
| 6,758,653 | B2 | 7/2004 | Morrison |
| 7,052,234 | B2 | 5/2006 | Wells et al. |
| 7,303,371 | B2 | 12/2007 | Tiemann et al. |
| 7,329,087 | B2 | 2/2008 | Cairo et al. |
| 7,452,182 | B2 | 11/2008 | Vance et al. |
| 7,484,936 | B2 | 2/2009 | Bouchard et al. |
| 7,488,157 | B2 | 2/2009 | Marini et al. |
| 7,600,970 | B2 | 10/2009 | Bhate et al. |
| 7,604,456 | B2 | 10/2009 | Schiavo et al. |
| 7,625,170 | B2 | 12/2009 | Greene et al. |
| 7,648,336 | B2 | 1/2010 | Cairo |
| 7,824,152 | B2 | 11/2010 | Morrison |
| 8,011,892 | B2 | 9/2011 | Ramlogan et al. |
| 8,137,072 | B2 | 3/2012 | Kim et al. |
| 2006/0121265 | A1 | 6/2006 | Thompson et al. |
| 2007/0065285 | A1 | 3/2007 | Cairo et al. |
| 2008/0089781 | A1 | 4/2008 | Johnson et al. |
| 2008/0199307 | A1 | 8/2008 | Keller |
| 2009/0232644 | A1 | 9/2009 | Greene et al. |
| 2010/0068034 | A1 | 3/2010 | Schiavo et al. |
| 2010/0327535 | A1 | 12/2010 | Grace et al. |
| 2011/0085899 | A1 | 4/2011 | Foster et al. |
| 2012/0128498 | A1 | 5/2012 | Basiletti et al. |
| 2013/0001321 | A1* | 1/2013 | Pelletier et al. ..... 239/265.11 |

* cited by examiner

EDGE SEAL FOR GAS TURBINE ENGINE CERAMIC MATRIX COMPOSITE COMPONENT

CROSS REFERENCE TO RELATED APPLICATIONS

This application claims priority to and the benefit of U.S. Provisional Patent Application No. 61/768,450,filed 23 Feb. 2013,the disclosure of which is now expressly incorporated herein by reference.

TECHNICAL FIELD

The present application relates to edge seals for gas turbine engine blades, vanes, airfoils, platforms, end walls, and shrouds, and more particularly, but not exclusively, to edge seals of gas turbine engine components having a ceramic matrix composition.

BACKGROUND

The sealing of edges of gas turbine engine components such as blades and vanes, and the airfoils, platforms, end walls, and shrouds that make up such components, remains an area of interest. Some existing systems and methods have various shortcomings, drawbacks, and disadvantages relative to certain applications. Accordingly, there remains a need for further contributions in this area of technology.

SUMMARY

One embodiment of the present application is a unique edge seal between ceramic matrix composite components, in which the edge seal is formed by offsetting plies during layup that form an integral projection on one component and a recess in the other component. Other embodiments include apparatuses, systems, devices, hardware, methods, and combinations for sealing the edges of gas turbine engine components such as blade platforms and shrouds, and turbine vane end walls. Further embodiments, forms, features, aspects, benefits, and advantages of the present application shall become apparent from the description and figures provided herewith.

BRIEF DESCRIPTION OF THE FIGURES

Features of the application will be better understood from the following detailed description when considered in reference to the accompanying drawings, in which.

DETAILED DESCRIPTION OF REPRESENTATIVE EMBODIMENTS

Figure 1:
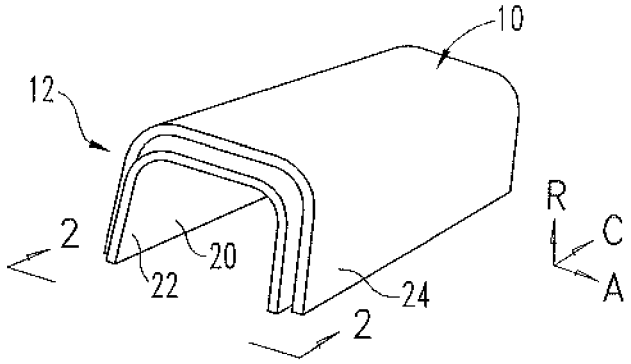
FIG. 1 is a partial perspective view of a ceramic matrix composite (CMC) blade platform of a gas turbine engine according to an embodiment.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein, are contemplated as would normally occur to one skilled in the art to which the invention relates.

FIG. 1 shows an edge seal 12 of a ceramic matrix composite (CMC) blade platform 10 of a gas turbine engine according to an embodiment. One or more airfoils (not shown) can be integrated into or mounted with respect to the platform 10, as will be described in greater detail below. Although the edge seal 12 is described herein in the context of a platform 10 of a blade, the edge seal 12 can be applied to any gas turbine engine CMC component for which sealing between gas turbine engine components is necessary or desired. In one form, for example, the edge seal 12 can be applied to seal the edges of the tip shrouds of circumferentially spaced blades, or the end walls of circumferentially spaced vanes. In another form, the edge seal 12 can be applied to seal the upper or lower end of an airfoil to a blade platform or a vane end wall. As will be described in greater detail below, the edge seal 12 can serve to reduce and control fluid flow between blade platforms, vane end walls, shroud edges, and other gas turbine engine components.

Figure 2:
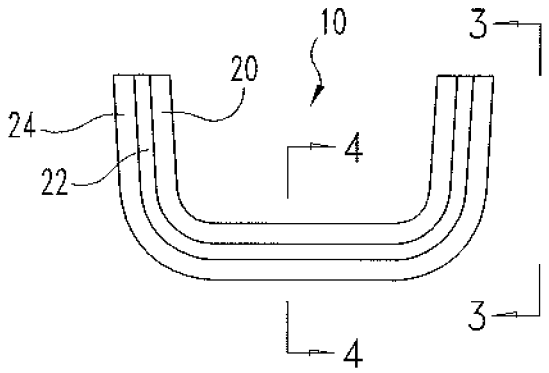
FIG. 2 is an end elevational view of the CMC blade platform of FIG. 1 according to an embodiment.

In the FIG. 1 embodiment, the reference characters A, R, and C represent the respective axial, radial, and circumferential directions or axes of the CMC blade platform 10 and, more generally, the gas turbine engine of which it is a part. For ease of description, the build-up of the platform 10 is described herein as by way of a ply lay-up fabrication process, it being understood that other fabrication processes may also be suitable. As shown in FIGS. 1 and 2, the illustrative platform 10 has a generally inverted U-shape when viewed in the circumferential direction C. The platform 10 can include a building up of layers of pre-impregnated (also referred to herein as "prepreg") ceramic preforms or dry woven ceramic fabric, where the preform or fabric is pre-impregnated with a polymer or resin, for example. As shown in the embodiment illustrated in FIGS. 1-4, the platform 10 has a bottom layer 20 of plies 18, a middle layer 22 of plies 18, and a top layer 24 of plies 18. When laying up the plies 18 that make up the platform 10, the middle layer 22 of plies 18 is offset relative to the bottom and top layers 20, 24 of plies 18. The amount of offset can be about the same as for example the total thickness of the middle layer 22 of plies 18.

Figure 3:
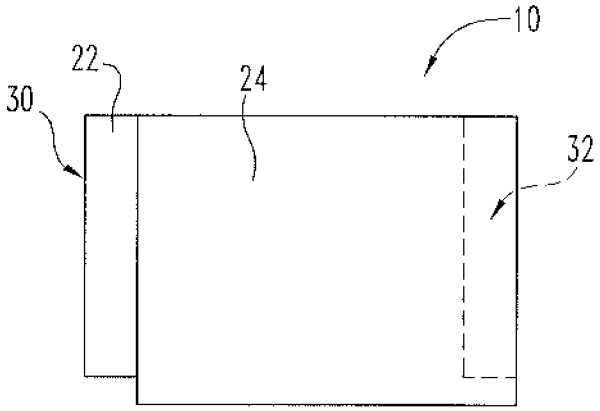
FIG. 3 is a side elevational of the CMC blade platform of FIG. 2 taken at elevation 3-3 of FIG. 2.
Figure 4:
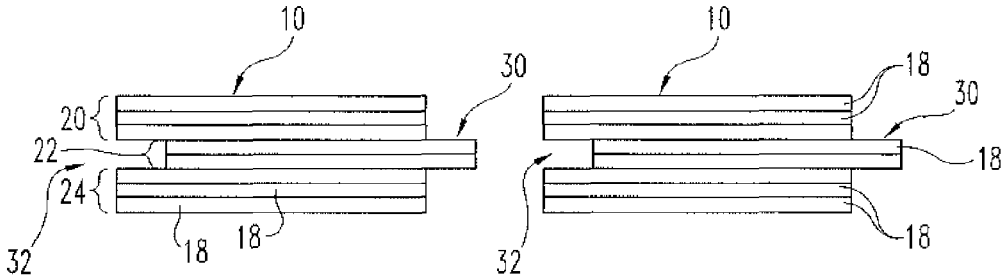
FIG. 4 is a cross sectional view of the CMC blade platform of FIG. 2 taken at cross section 4-4 of FIG. 2, and duplicated to show the interface between circumferentially spaced platforms.

As shown in FIGS. 3 and 4, the offset creates a protrusion 30 (that is, tongue) on one side of the platform 10 and a recess 32 (that is, groove) on the other side of the platform 10, along the edges of the platform 10 and in the circumferential direction C of the gas turbine engine. The protrusion 30 is made of the plies 18 of the middle layer 22, and the recess 32 is formed by an opening corresponding in circumferential length to the offset of the middle layer 22 of plies 18 and flanked by the inner and outer layers 20, 24 of plies 18. When the CMC blade platforms 10 are assembled together, the protrusion 30 of the end of one platform 10 of one blade engages the recess 32 of the end of the platform 10 of the circumferentially spaced blade, that is, the next blade in the circumferential direction. The engagement creates tortuous paths for fluid such as cooling air to leak through, and thereby provide a sealing function between the circumferentially spaced platforms 10.

In the illustrative embodiment, the number of plies 18 in the bottom and top layers 20, 24 is shown to be three, and the number of plies 18 in the middle layer 22 is shown to be two. The platform 10 is not limited to such configuration and other embodiments are contemplated. In one form, the number of plies 18 in each layer 20, 22, 24 can be different among the three layers 20, 22, 24. In another form, the number of plies 18 in each layer 20, 22, 24 can be the same among the three layers 20, 22, 24. The present application also is not limited to plies 18 having the same thickness, or the same length in the circumferential direction, among the three layers 20, 22, 24, as shown in FIG. 4. Different length plies and/or different thickness plies are also contemplated. In one form, for example, the middle layer 22 of plies 18 can be shorter in length and greater in thickness than the bottom and top layers 20, 24 of plies 18. Further, the number of plies 18 per layer, and the number of layers per platform 10, need not be limited to that shown in the embodiment of FIGS. 1-4. As will be appreciated, the number of plies and the number of layers can be selected based on the particular application of the CMC blade platform 10 and the gas turbine engine.

In the embodiment of FIGS. 1-4, the protrusions 30 and recesses 32 are formed in the blade platform 10 by way of a building up process, that is, a laying up of prepreg ceramic plies in an offset manner. In an alternative embodiment, the protrusions 30 and recesses 32 can be machined into the blade platform 10, or other gas turbine engine component, at an intermediate or final processing step. In a further alternative embodiment, the protrusions 30 and recesses 32 can be formed by a combination of offsetting of layers and machining at an intermediate or final step.

As noted, one or more airfoils can be integrated into the CMC blade platform 10. In one form, for example, an airfoil can be formed by one or more of the same plies 18 that form the CMC blade platform 10 in the lay up fabrication process. Similarly, airfoil(s) can be integrated into the CMC blade shroud or, in the case of a turbine vane, airfoil(s) can be integrated into the CMC vane end wall or end walls, as the case may be.

In an embodiment, a turbine vane can be made up of a CMC airfoil portion and end walls disposed at the radially inner and radially outer ends of the airfoil portion, and edge seals between the airfoil portion and end walls. The airfoil can be fabricated separately from the end walls. The separately fabricated airfoil can then be joined to the end walls, for example, by interlocking or other suitable means. In one form, the end walls can comprise a ceramic matrix composite (CMC). In another form, the end walls can comprise metal. The edge seal can be provided to reduce the leakage at the interface between the airfoil and the end walls at its opposite ends. The edge seal can employ a similar offset type construction as that of the edge seal 12 of the blade platform 10 described with respect to the FIG. 1 embodiment. Thus, for example, a groove can be machined in the CMC or metal end walls, and the CMC airfoil can be fabricated to have a corresponding protrusion at its radially inner and radially outer ends. The grooves of the end walls receive the respective protrusions of the airfoil, which serves to create a tortuous leakage path for fluid to leak through, and thereby reduce leakage. In one form, the protrusions of the CMC airfoil can be fabricated by laying down middle plies that are greater in length in the radial direction (the airfoil span direction) than the inner and outer plies.

Figure 5:
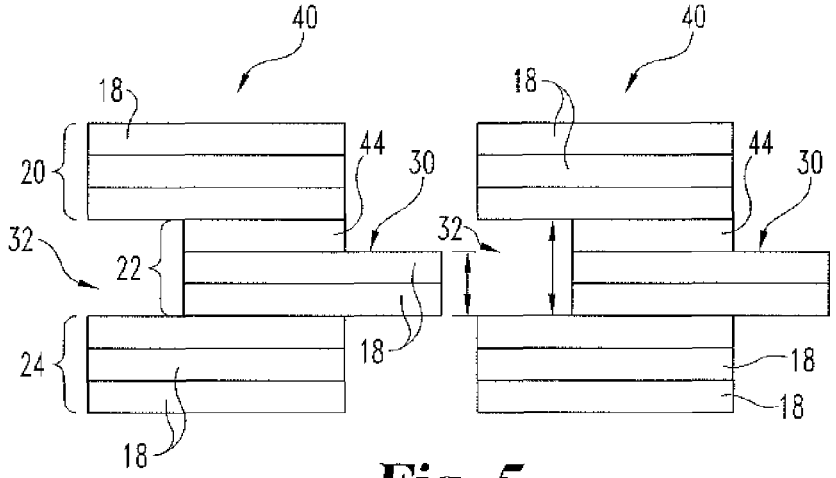
FIG. 5 is a cross sectional view of a CMC blade platform according to another embodiment.

FIG. 5 shows another embodiment of a CMC blade platform 40. In the FIG. 5 embodiment, the edge seal includes a protrusion 30 and a recess 32, where the protrusion 30 is made slightly thinner than the recess 32 by, for example, removing a ply 18 from the protrusion 30. This can be done, for example, by reducing the length in the circumferential direction of one of the plies in the middle layer 22, for example ply 44, relative to the other plies 18 in the middle layer 22. As shown in FIG. 5, the protrusion 30 has a height, a, that is less than that of the recess 32, which has a height, b. Owing to the relatively smaller height protrusion 30, the edge seal of the FIG. 5 embodiment makes assembly of the blade platforms 40 easier, and reduces local bending stresses.

Figure 6:
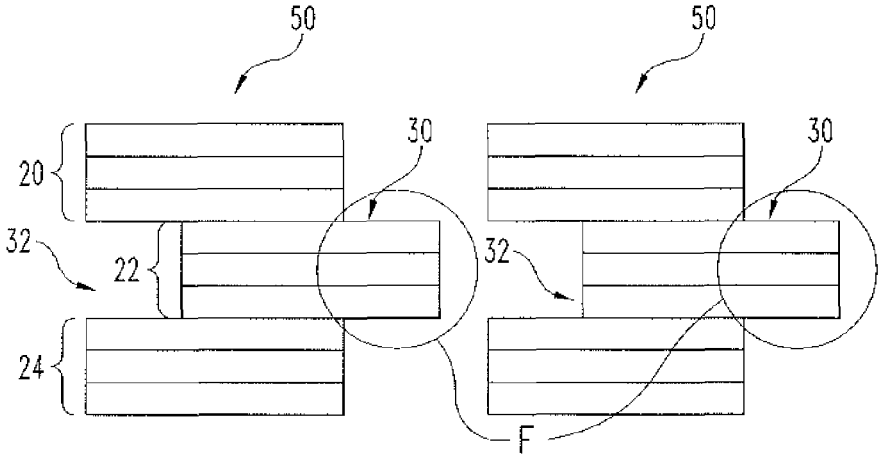
FIG. 6 is a cross sectional view of a CMC blade platform according to another embodiment.

FIG. 6 shows another embodiment of a CMC blade platform 50. During the infiltration process of the platform 50, the protrusion 30 portion of the platform 50 is infiltrated less than the remaining portions of the platform 50. The infiltration process can comprise any suitable process or combination of processes, for example, a chemical vapor infiltration process, a slurry infiltration process, and/or a melt infiltration process. In the FIG. 6 embodiment, the portion with less matrix infiltration is indicated by the reference character F. Less infiltration can result in less matrix material, which, in turn, can result in the protrusion 30 being less stiff, that is, more compliant. Owing to the more compliant protrusion 30, the edge seal of the FIG. 6 embodiment makes assembly of the blade platforms 50 easier, and reduces local bending stresses. As will be appreciated, in still a further embodiment, a CMC blade platform can combine the features of the embodiments of FIGS. 5 and 6, to form a protrusion having reduced thickness and less infiltration.

Figure 7:
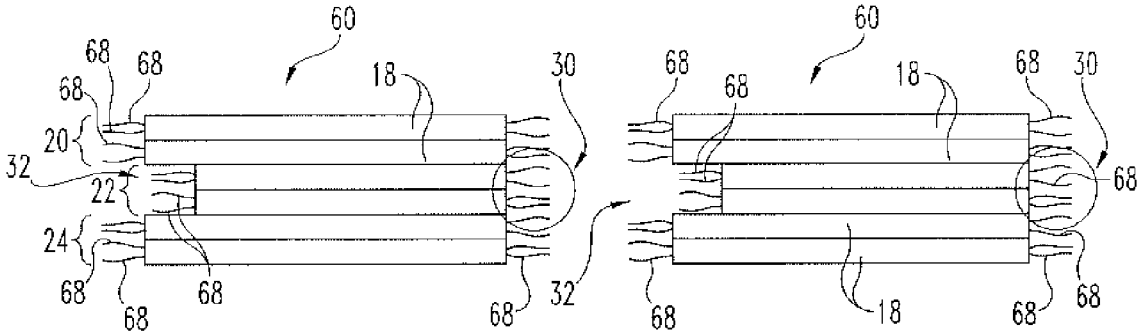
FIG. 7 is a cross sectional view of a CMC blade platform according to another embodiment.

FIG. 7 shows another embodiment of a CMC blade platform 60. Here, the edge seal serves as a brush seal between circumferentially spaced CMC blade platforms 60. The edge seal comprises fiber 68 that projects from the plies 18 of the layers 20, 22, 24 in both circumferential directions, that is, from both ends of the platform 60. The edge seal includes a protrusion 30 and a recess 32. The protrusion 30 (shown encircled in FIG. 7) is made of fiber 68 projecting from the plies 18 of the middle layer 22. The recess 32 is formed by a relatively shorter length middle layer 22 of plies 18 flanked by relatively longer inner and outer layers 20, 24 of plies 18. Within the recess 32 is fiber 68 projecting from the plies 18 of the middle layer 22. It will be appreciated that the recess 32 could alternatively, or additionally, be formed by offsetting the plies 18 of the middle layer 22 relative to the plies 18 of the radially inner and outer layers 20, 24, by a process described herein for example. When the CMC blade platforms 60 are assembled together, the fiber tow protrusion 30 of the end of one platform 60 of one blade is received in the recess 32 of the end of the platform 60 of the circumferentially spaced blade 60. The fiber 68 of the protrusion 30 and the fiber 68 within the recess 32 form a ceramic brush seal that serves to reduce and control fluid flow between edges of the circumferentially spaced CMC blade platforms 60.

Figure 8:
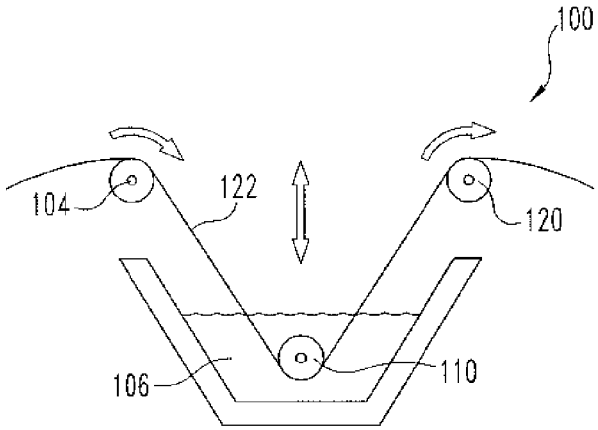
FIG. 8 is an end elevational view of a prepreg apparatus used in a method of forming a prepreg according to an embodiment.
Figure 9:
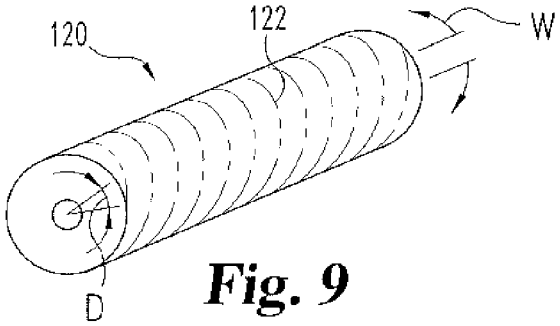
FIG. 9 is a perspective view of a drum having dry and impregnated portions of fiber wound thereon according to an embodiment.

Turning now to FIGS. 8 and 9, a method of fabricating a preform with fibers at opposite ends according to an embodiment will now be described. FIG. 8 shows a prepreg apparatus 100 including a spool 104, a matrix bath 106, a bath roller 110, an intermediate roller 114, and a take-up drum 120. The bath roller 110 can be selectively lowered into and raised from the matrix bath 106 by a not-shown raise-and-lower mechanism, as indicated by the arrow A in FIG. 8. FIG. 9 shows the take-up drum 120 having dry and impregnated fiber 122 wound thereon according to the present embodiment.

During the impregnation process, dry fiber 122, or tow, is drawn from the spool 104, about the bath roller 110 in the matrix bath 106, and over the intermediate roller 114. The matrix bath 106 holds a slurry containing ceramic matrix material (precursor). The fiber 122 is drawn through the matrix bath 106, where it undergoes slurry impregnation, before being wound on to the take-up drum 120. Any suitable drawing mechanism can be used to draw the fiber 122 about the roller 110, through the matrix bath 106, about the intermediate roller 114, and onto the take-up drum 120.

To create dry fiber ends, that is fiber ends that are not impregnated, the raise-and-lower mechanism periodically raises the roller 110 upward to remove the fiber 122 (or tow) from the matrix bath 106, so that the fiber 122 periodically skips the slurry impregnation process. In one form, the time period that the fiber 122 is removed from the matrix bath 106 can correspond to a percentage of the time to wind a full hoop of fiber 122 on to the take-up drum 120. Thus, for example, if the desired dry fiber length is to be 5% of the ply length at opposite ends of the ply, then the fiber 122 can be taken out of the slurry impregnation 10% of the time it takes to wind a full loop of fiber 122 on to the take-up drum 120. In this way, 10% of the wound fiber 122 along the circumference of the drum 120 is not impregnated with slurry. FIG. 9 shows the dry fiber 122, marked by dashed lines on the drum 120 and the reference character D, and the impregnated fiber 122, marked by the solid lines on the drum 120 and the reference character W. An axial cut can be made in the middle of the 10% circumferential length region D, resulting in a unidirectional ply of fiber material having a 5% circumferential length of dry fiber at each end of the ply. These types of plies can be used as the plies 18 in the layers 20, 22, 24 of the composite lay-up of, for example, the FIG. 7 blade platform 60 having the brush type edge seal.

In the embodiment of FIGS. 8-9, the cut of the wound fiber 122 is made in the middle of the non-impregnated portion D. The fabrication method need not be limited to a middle cut, and other embodiments are contemplated. In one form, for example, the wound fiber 122 can be cut at the location between the non-impregnated portion D and the impregnated portion W of the fibers 122, resulting in a ply of fiber material having a 10% circumferential length of dry fiber at one end of the ply, and little or no dry fiber at the other end of the ply. Still other percent circumferential length cuts can be made, as would occur to those skilled in the art. Although the ply described with respect to FIGS. 8-9 comprises a unidirectional reinforcement, it will be appreciated that other types of reinforcement may be suitable, for example, a woven fabric reinforcement.

Any theory, mechanism of operation, proof, or finding stated herein is meant to further enhance understanding of embodiment of the present invention and is not intended to make the present invention in any way dependent upon such theory, mechanism of operation, proof, or finding. In reading the claims, it is intended that when words such as "a," "an," "at least one," or "at least one portion" are used there is no intention to limit the claim to only one item unless specifically stated to the contrary in the claim. Further, when the language "at least a portion" and/or "a portion" is used the item can include a portion and/or the entire item unless specifically stated to the contrary.

While embodiments of the invention have been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein of by any of the following claims are desired to be protected. It should also be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow.

What is claimed is:

1. A gas turbine engine ceramic matrix composite (CMC) component comprising:

first and second outer layers of plies, and an intermediate layer of plies between the first and second outer layers of plies;

the intermediate layer of plies being offset relative to the first and second outer layers of plies;

wherein the offset forms a protrusion on one side of the CMC component and a recess in an opposite side of the CMC component such that when two CMC components are assembled together, the protrusion of the one CMC component engages the recess of the other CMC component to form an edge seal between the CMC components, wherein the protrusion is less infiltrated than other portions of the CMC component.

2. The gas turbine engine CMC component of claim 1 in which the protrusion is formed by the plies of the intermediate layer of plies and the recess is formed by an opening corresponding in length to the offset of the intermediate layer of plies and flanked by the first and second outer layers of plies.

3. The gas turbine engine CMC component of claim 1 in which the protrusion is less in height than the recess by at least the thickness of one ply in the intermediate layer of plies.

4. The gas turbine engine CMC component of claim 1 in which the amount of offset is about the same as the total thickness of the intermediate layer of plies.

5. A method comprising laying up plies of fiber in an offsetting manner to form a first ceramic matrix composite (CMC) gas turbine engine component having an integral projection at one end thereof and an integral recess in an opposing end thereof such that, when the first CMC gas turbine engine component is assembled to a second CMC gas turbine engine component, the integral recess in the first CMC component is capable of receiving an integral projection of the second CMC gas turbine engine component to form an edge seal between the the first and the second CMC gas turbine engine components, and matrix infiltration processing the laid up plies of material wherein the integral projection portion is less infiltrated than other portions of the first CMC as turbine engine component.

6. The method of claim 5 in which the laying up of plies comprises providing relatively less ply material in the integral projection so that the integral projection is less in height than the height of the integral recess.

7. The method of claim 5 in which the laying up of plies comprises laying up a bottom layer of plies, a middle layer of plies, and a top layer of plies, where the middle layer of plies is offset relative to the bottom and top layers of plies such that the integral projection is formed by the plies of the middle layer, and the integral recess is formed by an opening corresponding in length to the offset of the middle layer of plies and flanked by inner and outer layers of plies.

8. The method of claim 7 in which the laying up of plies comprises reducing the length of a portion of the plies in the middle layer relative to other plies of the middle layer so that the integral projection is less in height than the height of the integral recess.

9. A method comprising laying up plies of fiber in an offsetting manner to form a first ceramic matrix composite (CMC) gas turbine engine component having an integral projection at one end thereof and an integral recess in an opposing end thereof such that, when the first CMC gas turbine engine component is assembled to a second CMC as turbine engine component, the integral recess in the first CMC component is capable of receiving an integral projection of the second CMC gas turbine engine component to form an edge seal between the the first and the second CMC gas turbine engine components, in which the laying up of plies comprises laying up a bottom layer of plies, a middle layer of plies, and a top layer of plies, where the middle layer of plies is offset relative to the bottom and top layers of plies such that the integral projection is formed by the plies of the middle layer, and the integral recess is formed by an opening corresponding in length to the offset of the middle layer of plies and flanked by inner and outer layers of plies, and matrix infiltration processing the bottom, middle, and top layers of plies, wherein the integral projection portion of the middle layer of plies is less infiltrated than other portions of the middle layer of plies.

10. A method comprising laying up plies of fiber in an offsetting manner to form a first ceramic matrix composite (CMC) gas turbine engine component having an integral projection at one end thereof and an integral recess in an opposing end thereof such that, when the first CMC gas turbine engine component is assembled to a second CMC gas turbine engine component, the integral recess in the first CMC component is capable of receiving an integral projection of the second CMC gas turbine engine component to form an edge seal between the the first and the second CMC as turbine engine components, wherein laying up plies of fiber in an offsetting manner to form the first CMC gas turbine engine component having the integral projection at one end thereof and the integral recess in the opposing end thereof comprises laying up fiber that has a matrix-impregnated portion and a non-matrix-impregnated portion, wherein the non-matrix-impregnated portion forms the integral projection.

11. A method comprising laying up plies of fiber in an offsetting manner to form a first ceramic matrix composite (CMC) gas turbine engine component having an integral projection at one end thereof and an integral recess in an opposing end thereof such that, when the first CMC gas turbine engine component is assembled to a second CMC gas turbine engine component, the integral recess in the first CMC component is capable of receiving an integral projection of the second CMC gas turbine engine component to form an edge seal between the the first and the second CMC gas turbine engine components, wherein laying up plies of fiber in an offsetting manner to form the first CMC gas turbine engine component having the integral projection at one end thereof and the integral recess in the opposing end thereof comprises laying up fiber that has a matrix-impregnated portion and a non-matrix-impregnated portion, wherein the non-matrix-impregnated portion projects into the recess.

12. A method comprising laying up plies of fiber in an offsetting manner to form a first ceramic matrix composite (CMC) gas turbine engine component having an integral projection at one end thereof and an integral recess in an opposing end thereof such that, when the first CMC gas turbine engine component is assembled to a second CMC as turbine engine component, the integral recess in the first CMC component is capable of receiving an integral projection of the second CMC gas turbine engine component to form an edge seal between the the first and the second CMC gas turbine engine components, wherein laying up plies of fiber in an offsetting manner to form the first CMC gas turbine engine component having the integral projection at one end thereof and the integral recess in the opposing end thereof comprises laying up fiber that has a matrix-impregnated portion and a non-matrix-impregnated portion, wherein the non-matrix-impregnated portion forms the integral projection at one of the CMC gas turbine engine component and projects into the recess at the other end of the CMC gas turbine engine component, so that when the one CMC gas turbine engine component is assembled to the other CMC gas turbine engine component, the non-matrix-impregnated portion of the integral projection and the non-matrix-impregnated portion within the recess form a brush seal.

13. A method comprising providing at least one radially inner end wall and at least one radially outer end wall, where each end wall has a groove therein;

forming a ceramic matrix composite (CMC) airfoil by laying up a bottom layer of plies, a middle layer of plies, and a top layer of plies, where the middle layer of plies is relatively longer in a radial direction than the bottom and top layers of plies such that radially projecting tongues are formed by the plies of the middle layer at radially inner and radially outer ends of the CMC airfoil;

joining the CMC airfoil to the end walls by engaging the radially projecting tongues at the radially inner and radially outer ends of the CMC airfoil with the respective grooves in the radially inner and radially outer end walls;

drawing a ceramic fiber tow through a matrix bath containing a slurry matrix composition to matrix-impregnate the ceramic fiber tow;

periodically removing the ceramic fiber tow from the matrix bath so that portions of the drawn ceramic fiber tow are not matrix-impregnated;

winding the ceramic fiber tow onto a drum to form a circumferential ply of fiber material having an impregnated circumferential portion and a non-impregnated circumferential portion; and axially cutting the circumferential ply of fiber material to form a ply of fiber material having a matrix-impregnated portion and a non-matrix-impregnated portion at one or both ends of the matrix-impregnated portion.

14. The method of claim 13 in which one or more of the radially inner end wall and one or more of the radially outer end wall comprise the ceramic matrix composite (CMC).

15. The method of claim 13 in which one or more of the radially inner end wall and the radially outer end wall comprise metal.

16. The method of claim 13 in which the time period that the drawn ceramic fiber tow is removed from the matrix bath corresponds to a percentage of time it takes to wind a full hoop of ceramic fiber tow on to the drum.

17. The method of claim 13 in which the axial cut is made in the middle of the non-impregnated circumferential portion to form a ply of fiber material having a matrix-impregnated portion and circumferential length non-matrix-impregnated portions at the opposite ends of the matrix-impregnated portion.

* * * * *